United States Patent [19]

Jones

[11] 4,114,728

[45] Sep. 19, 1978

[54] VEHICLE-LIFT SUPERSTRUCTURE

[76] Inventor: John Alexander Jones, 6312 Fairfield Dr., Flourtown, Pa. 19031

[21] Appl. No.: 829,635

[22] Filed: Sep. 6, 1977

[51] Int. Cl.[2] ..... B66F 7/28

[52] U.S. Cl. ..... 187/8.75

[58] Field of Search ..... 187/8.41, 8.45, 8.54, 187/8.59, 8.67, 8.72, 8.74, 8.75

[56] References Cited

U.S. PATENT DOCUMENTS 3,149,699 9/1964 Wallace ..... 187/8.75

FOREIGN PATENT DOCUMENTS 792,753 4/1958 United Kingdom ..... 187/8.74

828,444 2/1960 United Kingdom ..... 187/8.75

*Primary Examiner*—John J. Love

*Assistant Examiner*—Jeffrey V. Nase

*Attorney, Agent, or Firm*—Howson and Howson

[57] ABSTRACT

A lift superstructure of the type comprising a bolster plate mounted on the top of a lift piston and having two horizontally pivotable swinging arms extending from each side for supporting a vehicle upon them, wherein each pair of swing arms extending from a given side of the bolster is mounted and pivoted upon the top half of the bolster opposite from the edge from which the pair of swing arms extends, so that the pivoted ends of the two pairs of swing arms overlap each other partially. Preferably the two swing arms extending from one edge are located between the swing arms extending from the opposite edge, with respect to a dimension extending generally at right angles to the swing arms. A safety bridge in the form of a generally U-shaped bracket preferably extends over each adjacent pair of swing arms and is fastened to the top surface of the bolster, to provide safety restraint of the swing arms should a pivot bolt break. The arrangement makes possible a considerably narrower bolster plate than is usually employed while retaining sufficient support of the swing arms by the bolster plate, and because of the narrower bolster plate dimension the underside of the vehicle being lifted is made more readily accessible for observation and work thereon.

5 Claims, 5 Drawing Figures

VEHICLE-LIFT SUPERSTRUCTURE

BACKGROUND OF THE INVENTION

Lift superstructures are known which are designed to lift a vehicle for observation and/or repair, as in an auto service station or garage, for example. Normally the superstructure is mounted on the piston of a hydraulic system, which raises the superstructure after the vehicle has positioned itself above the appropriate points on the superstructure, and which is allowed to descend after work or observation is completed.

Typically the superstructure comprises a nearly-square bolster plate, or bolster, mounted on the top of the lift piston, with horizontally-pivotable swing arms each mounted near a different corner of the plater. While satisfactory for many purposes, the relatively large area of bolster does tend to obscure a substantial portion of the underside of the vehicle while the lift is in use, in some cases seriously interfering with the observation or work which it is desired to perform on the vehicle. However, if the bolster is merely made smaller in area, it will not in general have sufficient strength, nor provide sufficient support for the swing arms which lie against its top.

Accordingly, it is an object of the invention to provide a new and useful vehicle-lift superstructure.

Another object is to provide such a superstructure utilizing a bolster of reduced area, thereby to reduce the area of the underside of the vehicle which the bolster obscures during use.

It is also an object of the invention to provide such a superstructure incorporating a safety arrangement to protect against damage in the event that one or more of the pivots for the swing arms should break.

SUMMARY OF THE INVENTION

These and other objects of the invention are attained by the provision of a vehicle-superstructure of the class comprising a bolster mountable on a lift piston and a plurality of horizontally-pivotable swing arms mounted on the top side of the bolster and extending therefrom for supporting the vehicle, in which lift structure a first swing arm and a second swing arm extend outward from one side edge of the bolster and are pivoted horizontally about respective first and second vertical axes; these axes are spaced apart from each other along a predetermined dimension of the bolster, and pass through that half of the top of the bolster more remote from said one side edge. At least another of the swing arms extends outward from the opposite side edge of the bolster, and is pivotable about a third vertical axis which extends through that half of the top of the bolster more remote from said opposite side edge, and intermediate the first and second axes along the direction parallel to said dimension. With this construction, the pivoted end portion of the third swing arm is positioned between the corresponding pivoted end portions of the first and second swing arms. Preferably a fourth swing arm is also mounted between the first and second swing arms so as to extend outwardly from said opposite side edge of the bolster and so as to be pivotable about a fourth vertical axis extending through that half of the top of the bolster more remote from said opposite side edge. In use, each of the swing arms rest upon and is supported by the top of the bolster. Because of the above-described partially overlapping, or interdigitated, arrangement of the swing arms, the bolster is substantially narrower than what otherwise would be necessary, while at the same time providing sufficient strength and sufficient support of the swing arms by the underlying top surface of the bolster. In addition, a safety cover, preferably in the form of a generally U-shaped bridge or bracket, extends over each adjacent pair of the swing arms and is secured to the top of the bolster, so that if one of the pivot bolts for one of the swing arms breaks, the safety bracket will catch and restrain the pivot end of the swing arm and minimize the danger that the vehicle might fall from the superstructure.

The construction of the invention also has the practical advantage that it can be made from pre-existing larger lift superstructures, by cutting down and appropriately forming same into the superstructure of the invention.

BRIEF DESCRIPTION OF FIGURES

These and other objects and features of the invention will be more readily understood from a consideration of the following detailed description, taken in connection with the accompanying drawings, in which.

DETAILED DESCRIPTION OF SPECIFIC EMBODIMENTS

Figure 1:
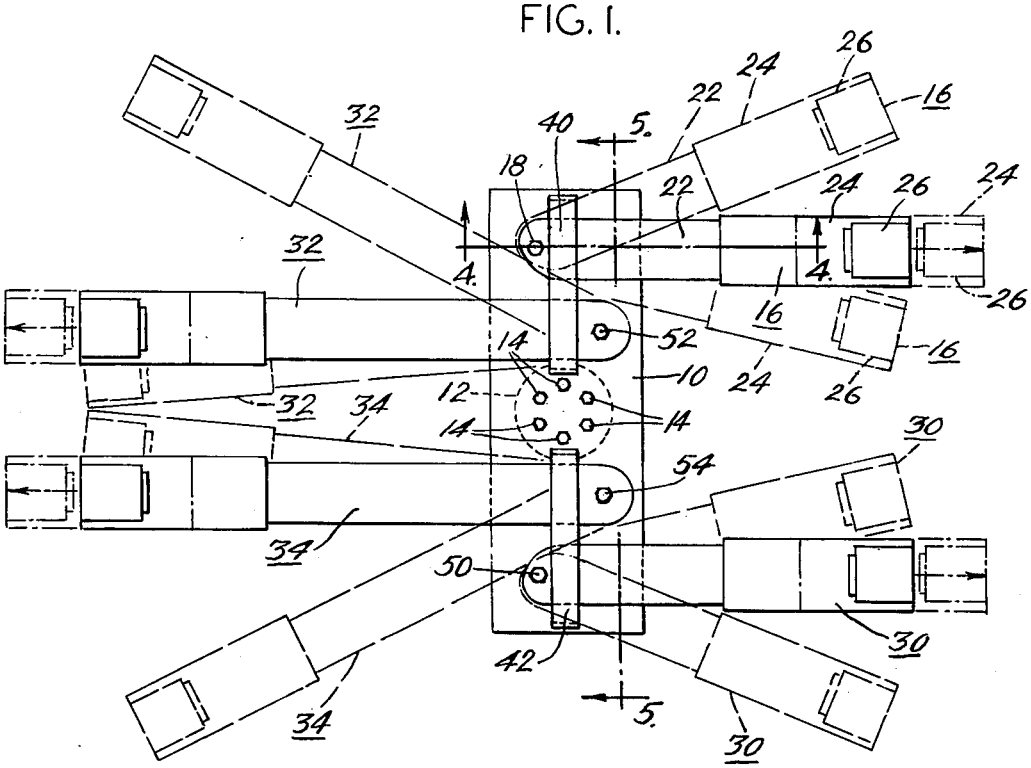
FIG. 1 is a plan view of a preferred embodiment of the invention, showing alternate positions of the swing arms in broken line.

Referring now to the embodiment of the invention shown in the drawings by way of example only, the bolster 10 in the form of a flat rectangular plate is mounted horizontally upon a lift piston 12 by means of a series of bolts such as 14. A first swing arm 16 is mounted on bolster 10 for horizontal pivoting by means of pivot bolt 18, which is threaded into the top of bolster 10 and tightened securely therein, until shoulder 20 abuts plate 10, allowing swing arm 16 to pivot freely.

Figure 2:
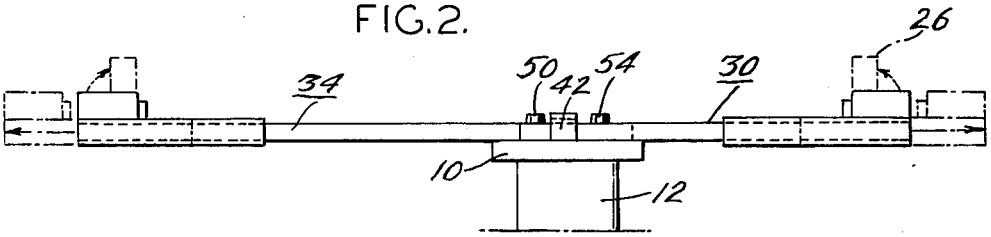
FIG. 2 is a side view of the embodiment of FIG. 1.
Figure 3:
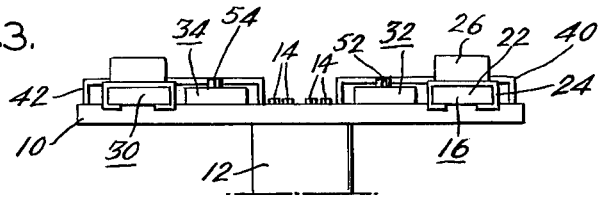
FIG. 3 is an end view of the embodiment of FIG. 1.
Figure 4:
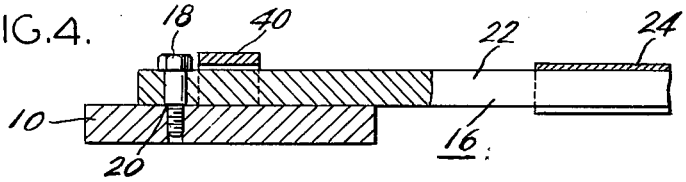
FIG. 4 is a sectional view taken along lines 4—4 of FIG. 1.
Figure 5:
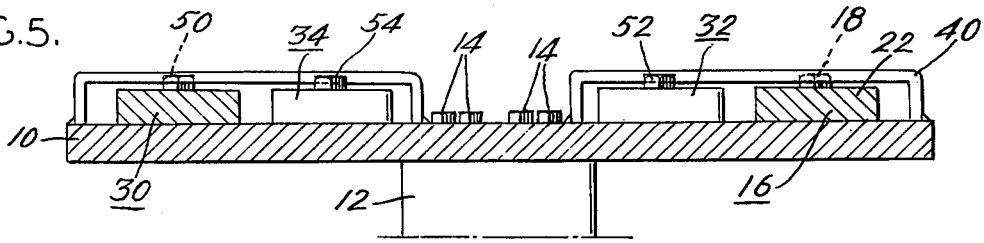
FIG. 5 is a sectional view taken along lines 5—5 of FIG. 1.

Swing arm 16 is in the main like those known in the prior art in that it consists of a flat bar 22 provided with a longitudinally sliding sleeve 24 carrying a riser pad 26. The entire arm can be pivoted horizontally within predetermined limits. The sleeve 24 can be slid along the bar 22 between the fully retracted position, and an extended position in which it overhangs the end of bar 22, as illustrated in broken line in FIG. 1; the riser pad 26 can be flipped up as shown in broken line in FIG. 2 for certain types of vehicle support, as is well known in this art.

Swing arm 30 may be identical with swing arm 16, with the possible exception of the details of the shaping of its surface near its pivoted end. Swing arms 32 and 34 may also be identical with swing arm 16, except that they are preferably of greater length as shown, and again with the exception that the surfaces of the swing arms 32 and 34 adjacent their pivot ends may differ somewhat from those of both arms 16 and 30.

Safety cover means in the form of two generally U-shaped brackets 40 and 42 are also employed, and are respectively welded into positions over the pivot arms 16 and 32 and over the pivot arms 30 and 34. The vertical portions of the safety bars and brackets are spaced sufficiently from the swing arms which they encompass to permit the desired range of angular pivot of the swing arms, and extend horizontally close to the top surfaces of the respective swing arms so that should one of the pivotables such as 18 break, the corresponding swing arm will be caught in the safety bracket before it tilts downward unduly or dangerously, to a degree such that the vehicle might tumble from the superstructure. If desired, the two safety brackets can be replaced by a single bracket extending over all of the swing arms.

Considering now the principal feature of the invention, corresponding to the pivot bolt 18 for swing arm 16 there are also provided the pivot bolts 50, 52, and 54 for swing arms 30, 32 and 34, respectively, which are all similar to pivot bolt 18 and provide a similar function for their respective swing arms. It is particularly noted that the vertical axes through the centers of the pivot bolts 18 and 50 are located on the left-hand side of the top surface of bolster 10 as viewed in FIG. 1, on that half of the top surface of bolster 10 more remote from the edge from which arms 16 and 30 extend. Similarly, the vertical pivot axis of pivot bolts 52 and 54 are located on the right-hand side of the bolster 10, i.e. on the side of the top surface thereof more remote from the edge from which swing arms 32 and 34 extend. The pivot ends of arms 32 and 34 are therefore positioned between the corresponding pivot ends of arms 16 and 30, along the length dimension of the top of the plate 10, and in a partially overlapping or interdigitated relationship thereto. As a result of this arrangement, a very substantial portion of the top surface of bolster 10 underlies each of the swing arms, despite the fact that the overall width of the bolster plate is relatively small. This is in contrast to the arrangements of the prior art in which, to obtain the same type of strength and support by the bolster 10, with each of the swing arms pivoted for example from near one of the corners of the bolster, the bolster would have to be much wider in order to provide the same length of supporting material under the swing arms.

Studies of the bolster plate 10 in this configuration with its associated swing arms pivoted substantially as shown have revealed that the resistance to the breaking of the bolster plate and to breaking or bending of any of the swing arms is very high, and at least comparable to those of previously-known types of similar superstructures.

By way of example only, one representative embodiment is as follows: the superstructure is of cold-rolled steel throughout, 1½ inches in thickness; the long swing arms are 31 inches long and the short swing arms are 20 inches long; all swing arms are 5½ inches wide; the pivot bolt axes in each case are 3 inches from the adjacent long edge of a 12-inch wide bolster plate; the bolster plate is 38 inches long; the safety brackets are each 2½ inches wide, 3 inches high, 16 inches long, and welded to the bolster plate; the pivot bolts are ¾ inch diameter, tack-welded or cemented into position to prevent working loose; the long arms extend about 20¼ inches beyond the opposite long edge of the bolster plate, when oriented at right angles thereto, and the short arms extend about 8¼ inches beyond the corresponding opposite bolster edge. With such a construction, it has been calculated that, using steel having a YP of 76,000 PSI and allowing a safety factor of 3, the rated load, applied at the extreme outer end of a longer arm, is about 2580 lbs.; for steel having a YP of 35,000 PSI, the corresponding rated load is about 1188 lbs. The corresponding ratings for the short arms, for the above-mentioned two types of steel, are about 6330 lbs. and 2915 lbs., respectively.

In order to permit the desired degrees of angular swing of the swing arms despite the overlapping positions of the swing arms and the presence of the edges of the safety brackets, the extreme pivot ends of any or all of the swing arms may be shaped or cut off to any desired contour, for example as shown in the drawing.

Thus there has been provided by the invention a narrowed bolster plate 10 permitting greater visibility and accessibility of the under parts of a vehicle supported on the superstructure, while retaining excellent strength characteristics, all obtained as a result of the pivoting of each of the swing arms from the side of the bolster opposite that from which the swing arm extends, resulting in an overlapping or interdigitated arrangement of the pivoted ends of the swing arms providing strong support of the swing arms by the bolster despite its narrowness.

While the invention has been described with particular reference with specific embodiments in the interest of complete definiteness, it may be embodied in a variety of forms diverse from those shown and described without departing from the spirit and scope of the invention as defined by the appended claims.

I claim:

1. In a vehicle-lift superstructure comprising a bolster mountable on a lift piston and a plurality of horizontally-pivotable swing arms mounted on the top side of said bolster and extending therefrom for supporting a vehicle, the improvement wherein a first and a second of said arms extend outward from one side edge of said bolster and are pivotable horizontally about respective first and second vertical axes, which axes:

(a) are spaced apart from each other along a predetermined dimension of said bolster, and (b) pass through that half of said top of said bolster more remote from said one side edge; and at least another of said arms extends outward from the opposite side edge of said bolster and is pivotable about a third vertical axis extending through that half of said top of said bolster more remote from said opposite side edge and intermediate said first and second axes along a direction parallel to said dimension, whereby the end portion of said third swing arm adjacent said third axis is positioned between the corresponding end portions of said first and second arms.

2. The superstructure of claim 1, comprising a fourth swing arm extending outward from said opposite side edge of said bolster and pivotable about a fourth vertical axis extending through that half of said top of said bolster more remote from said opposite side edge, said fourth axis being intermediate said first axis and said third axis along said direction.

3. The superstructure of claim 2, wherein at least a portion of the lower surface of each of said swing arms, in use, lies against said top of said bolster.

4. The superstructure of claim 2, comprising safety cover means secured to said bolster and extending over the tops of said swing arms.

5. The superstructure of claim 4, comprising first, second, third and fourth pivot bolts providing said first, second, third and fourth pivot axes, respectively, and said safety cover means comprises a first generally U-shaped bar extending over said first and said fourth swing arms and a second generally U-shaped bar extending over said third and said second swing arms, for restraining said swing arms in the event of breakage of any of said pivot bolts.

* * * * *